US009611066B2

(12) United States Patent
Bevier

(10) Patent No.: US 9,611,066 B2
(45) **Date of Patent: *Apr. 4, 2017**

(54) SHIPPING CONTAINER CONVERTIBLE TO A DISPLAY TRAY

(71) Applicant: INTERNATIONAL PAPER COMPANY, Memphis, TN (US)

(72) Inventor: Alex D. Bevier, Olive Branch, MS (US)

(73) Assignee: International Paper Company, Memphis, TN (US)

( * ) Notice: Subject to any disclaimer, the term of this patent is extended or adjusted under 35 U.S.C. 154(b) by 216 days.

This patent is subject to a terminal disclaimer.

(21) Appl. No.: 14/164,771

(22) Filed: Jan. 27, 2014

(65) Prior Publication Data

US 2015/0210423 A1 Jul. 30, 2015

(51) Int. Cl.

| | |
|---|---|
| ***B65D 5/00*** | (2006.01) |
| ***B65D 5/10*** | (2006.01) |
| ***B65D 5/52*** | (2006.01) |
| ***B65D 5/72*** | (2006.01) |
| ***B65D 5/468*** | (2006.01) |
| ***B31B 3/00*** | (2006.01) |
| ***B65D 5/22*** | (2006.01) |
| ***B65D 5/42*** | (2006.01) |
| ***A47F 5/11*** | (2006.01) |
| ***B65D 5/32*** | (2006.01) |

(52) U.S. Cl.

CPC ..... *B65D 5/42* (2013.01); *A47F 5/112* (2013.01); *B65D 5/323* (2013.01); *B65D 5/52* (2013.01)

(58) Field of Classification Search

CPC ..... B65D 5/001; B65D 5/10; B65D 5/22

USPC .. 229/242, 160, 235, 240, 122.32, 164, 199, 229/172; 206/774, 736; 53/485

See application file for complete search history.

(56) References Cited

U.S. PATENT DOCUMENTS

| | | | |
|---|---|---|---|
| 176,974 | A | 5/1876 | Maginn et al. |
| 3,343,659 | A | 9/1967 | Marondel |
| 5,277,360 | A | 1/1994 | DeMott |
| 5,333,777 | A | 8/1994 | Roth |
| 5,487,504 | A | 1/1996 | Baird |
| 5,657,872 | A | 8/1997 | Leftwich et al. |
| 5,950,914 | A | 9/1999 | Dunton et al. |
| 5,957,294 | A | 9/1999 | Kanter |
| 6,027,017 | A | 2/2000 | Kuhn et al. |
| 6,932,265 | B2 | 8/2005 | Sax et al. |

(Continued)

FOREIGN PATENT DOCUMENTS

GB 2162819 2/1986

*Primary Examiner* — Christopher Demeree

(74) *Attorney, Agent, or Firm* — Matthew M. Eslami

(57) ABSTRACT

A shipping container convertible to a display tray is provided and may comprise: a floor panel; first and second end panels; a first positioning panel defining a first notch with the first end panel; a side panel extending between the first and second end panels; and a first containment panel comprising a first main portion and a first end portion extending at an angle to the first main portion. The first end portion may be located in the first notch such that the first end panel and the first positioning panel frictionally engage the containment panel first end portion to frictionally hold the first containment panel in position. The first containment panel may be removable so as to convert the shipping container to a display tray.

19 Claims, 11 Drawing Sheets

(56) References Cited

U.S. PATENT DOCUMENTS

| | | | | |
|---|---|---|---|---|
| 7,080,736 | B2 | 7/2006 | Jackson et al. | |
| 7,083,048 | B2 * | 8/2006 | Taylor | B65D 5/48 206/736 |
| 7,331,508 | B2 | 2/2008 | Kanter et al. | |
| 7,478,745 | B2 | 1/2009 | Philips | |
| 7,607,566 | B2 | 10/2009 | Philips et al. | |
| 7,798,391 | B2 | 9/2010 | Tibbels et al. | |
| 7,981,017 | B2 * | 7/2011 | Little | B31B 1/14 206/509 |
| 2003/0019920 | A1 | 1/2003 | Quaintance | |
| 2005/0263434 | A1 | 12/2005 | Tibbels | |
| 2006/0196920 | A1 | 9/2006 | Moen | |
| 2010/0006456 | A1 | 1/2010 | Bevier | |
| 2015/0210424 | A1 | 7/2015 | Bevier | |

* cited by examiner

SHIPPING CONTAINER CONVERTIBLE TO A DISPLAY TRAY

FIELD OF THE INVENTION

The present invention relates to a shipping container having one or more containment panels, which can be removed so as to convert the shipping container into a display tray.

BACKGROUND OF THE INVENTION

Containers having removable panels are known in the prior art. For example, U.S. Pat. No. 5,333,777 discloses a container 1 having removable plate-like inserts 3, 3' which can be slipped into the container 1 adjacent the inner sides of flaps 15. The container 1 may contain reams of copy paper. The inserts 3, 3' prevent penetration of dust, moisture and/or other foreign matter through clearances or gaps between pairs of confronting flaps. Extraction of an insert affords access to the contents of the container.

SUMMARY OF THE INVENTION

In accordance with a first aspect of the present invention, a shipping container convertible to a display tray is provided and may comprise: a floor panel; first and second end panels; a first positioning panel defining a first notch with the first end panel; a side panel extending between the first and second end panels; and a first containment panel comprising a first main portion and a first end portion extending at an angle to the first main portion. The first end portion may be located in the first notch such that the first end panel and the first positioning panel frictionally engage the containment panel first end portion to frictionally hold the first containment panel in position. The first containment panel may be removable so as to convert the shipping container to a display tray.

The first and second end panels may be integral with the floor panel.

The shipping container may further comprise a second positioning panel defining a second notch with the second end panel. The first containment panel may further comprise a second end portion extending at an angle to the first main portion. The first containment panel second end portion may be located in the second notch such that the second end panel and the second positioning panel frictionally engage the containment panel second end portion.

The first and second end portions of the first containment panel may extend generally orthogonally to the first main portion.

The first positioning panel may be integral with the first end panel and the second positioning panel may be integral with the second end panel.

The first end panel may comprise a first main section and first and second end sections extending at an angle to the first main section.

The second end panel may comprise a second main section and third and fourth end sections extending at an angle to the second main section.

The first end section of the first end panel and the third end section of the second end panel may overlap the first containment panel first main portion.

The side panel may comprise a removable second containment panel. The removable second containment panel may comprise a second main portion and a third end portion extending at an angle to the second main portion. The third end portion may be located in a third notch defined by the first end panel and the first positioning panel such that the first end panel and the first positioning panel frictionally engage the second containment panel third end portion to frictionally hold the second containment panel in position. The second containment panel may be removable.

The second positioning panel and the second end panel define a fourth notch. The second containment panel may further comprise a fourth end portion extending at an angle to the second main portion. The second containment panel fourth end portion may be located in the fourth notch such that the second end panel and the second positioning panel frictionally engage the second containment panel fourth end portion.

The shipping container may further comprise a first upper panel integral with the side panel and a second upper panel integral with the first containment panel.

In an alternative embodiment, the shipping container may further comprise an upper panel integral with one of the side panel and the first containment panel and extend between the side panel and the first containment panel.

The containment panel is preferably not fastened, adhesively adhered or otherwise fixed or permanently secured to any other component of the container such as the first end panel, the second end panel, the first positioning panel and/or the second positioning panel.

In accordance with a second aspect of the present invention, a process is provided for converting a shipping container to a display tray. The process comprises providing a shipping container comprising: a floor panel; first and second end panels; a first positioning panel defining a first notch with the first end panel; a side panel extending between the first and second end panels; and a first containment panel comprising a first main portion and a first end portion extending at an angle to the first main portion, the first end portion located in the first notch such that the first end panel and the first positioning panel frictionally engage the containment panel first end portion. The process further comprises removing the first containment panel first end portion from the first notch.

The shipping container may further comprise a second positioning panel defining a second notch with the second end panel. The first containment panel may further comprise a second end portion extending at an angle to the first main portion. The first containment panel second end portion may be located in the second notch such that the second end panel and the second positioning panel frictionally engage the containment panel second end portion. The process may further comprise removing the first containment panel second end portion from the second notch.

In accordance with a third aspect of the present invention, a shipping container convertible to a display tray is provided comprising: a floor panel; first and second end panels; a first positioning panel comprising a first center section and a first outer section folded over onto the first center section so as to define a first dual layer center structure, the first positioning panel defining a first notch with the first end panel, wherein the first notch may has a width generally equal to a thickness of the first outer section; and a first containment panel comprising a first main portion and a first end portion extending at an angle to the first main portion. The first end portion may be located in the first notch such that the first end panel and the first positioning panel frictionally engage the containment panel first end portion to frictionally hold the first containment panel in position. The first containment panel may be removable so as to convert the shipping container to a display tray.

The shipping container may further comprise a second positioning panel comprising a second center section and a second outer section folded over onto the second center section so as to define a second dual layer center structure, said second positioning panel defining a second notch with the second end panel. The second notch may have a width generally equal to a thickness of the second outer section. The first containment panel may further comprise a second end portion extending at an angle to the first main portion. The first containment panel second end portion may be located in the second notch such that the second end panel and the second positioning panel frictionally engage the containment panel second end portion.

In accordance with a fourth aspect of the present invention, a blank adapted to be formed into a display tray is provided comprising: a floor panel; first and second end panels integral with the floor panel; a first positioning panel comprising a first center section integral with the first end panel and a first outer section integral with the first center section; and a second positioning panel comprising a second center section integral with the second end panel and a second outer section integral with the second center section.

The first positioning panel further comprises first and second end sections integral with and extending laterally from the first center section. The first center section and the first outer section may have a length less than a length of the first end panel.

The first and second end sections define notches with the first end panel.

A first set of double fold lines may be provided between the first positioning panel center section and the first end panel and a second set of double fold lines may be provided between the second positioning panel center section and the second end panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
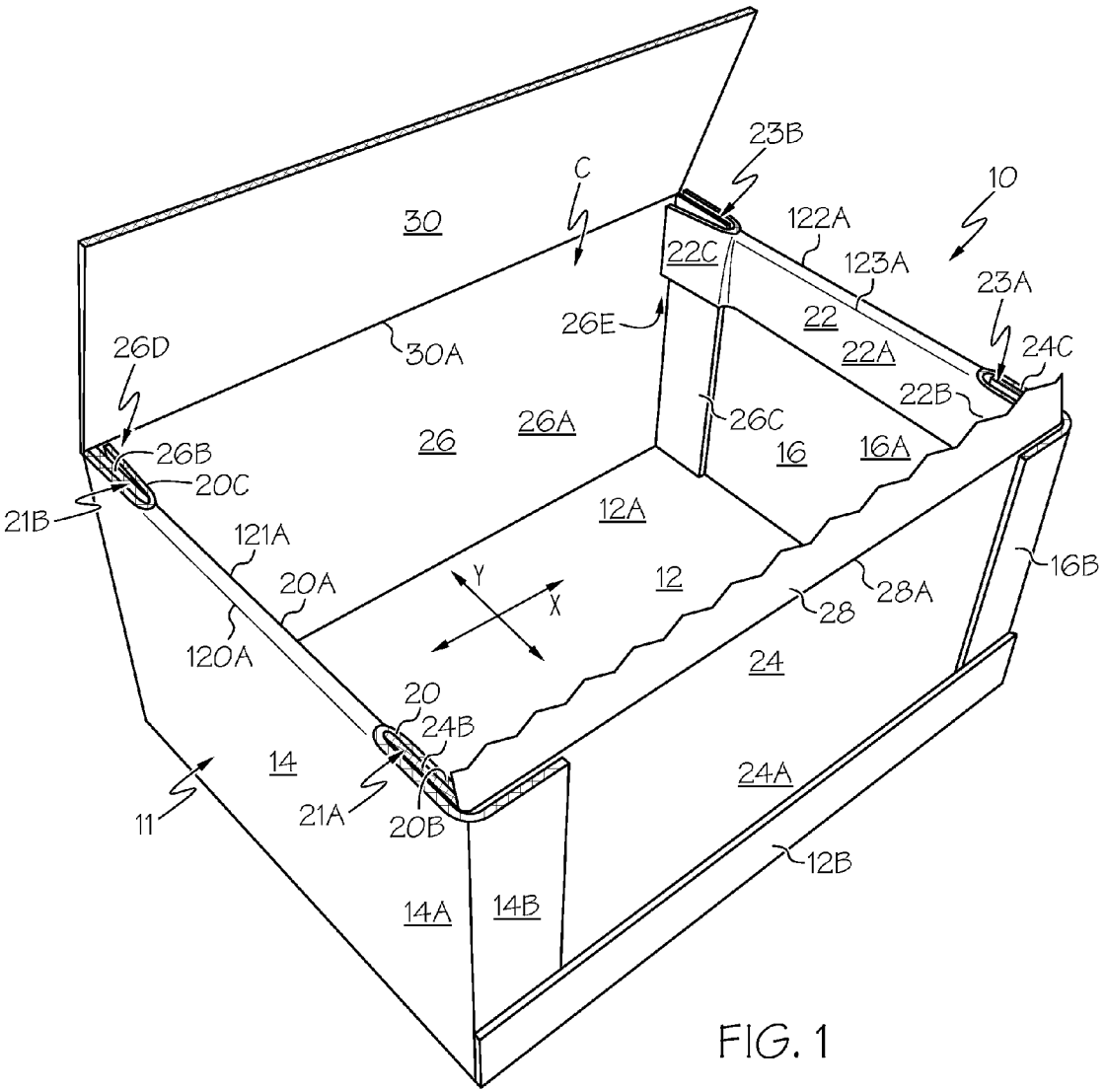
FIG. 1 is a perspective view of a shipping container of a first embodiment of the present invention, wherein one of the closing panels has been partially removed.
Figure 2:
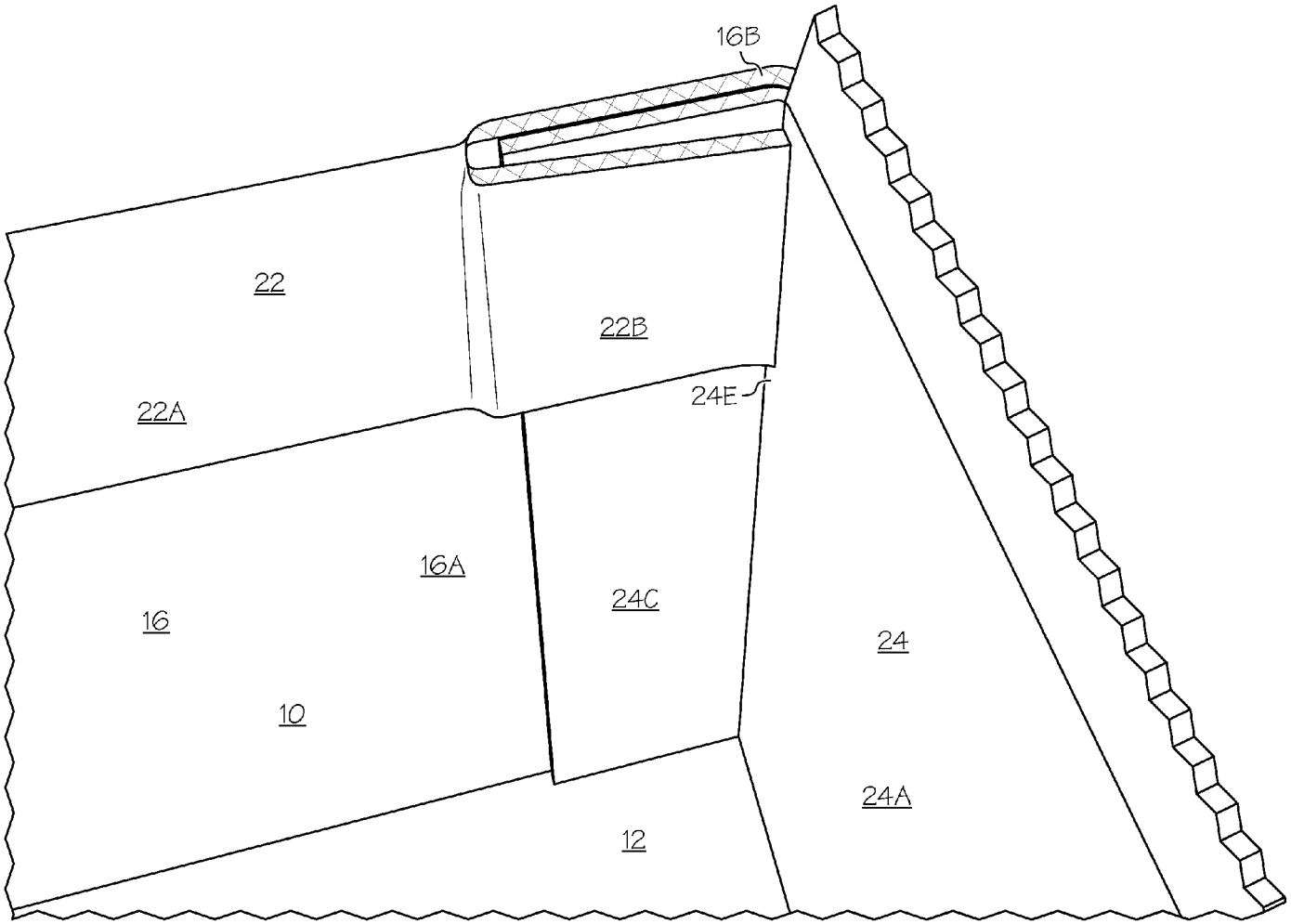
FIG. 2 in an enlarged view of a corner of the container illustrated in FIG. 1.

A shipping container 10 convertible to a display tray 11, constructed in accordance with the present invention, is illustrated in FIG. 1. The shipping container comprises the display tray 11 and at least one containment panel. More specifically, the shipping container 10 comprises a floor panel 12, first and second end panels 14 and 16 integral with the floor panel 12, first and second positioning panels 20 and 22, integral respectively with the first and second end panels 14 and 16, and first and second removable containment panels 24 and 26, see FIGS. 1-5. The floor panel 12, the first and second end panels 14 and 16 and the first and second positioning panels 20 and 22 are formed, in the illustrated embodiment, as a single blank or structure 100, see FIG. 6. The blank 100, once assembled and without the containment panels 24 and 26, defines the display tray 11. The first and second containment panels 24 and 26 define first and second removable side panels. First and second upper closing panels 28 and 30 are integral respectively with the first and second containment panels 24 and 26, see FIG. 1. The first closing panel 28 is foldable about a fold line 28A extending between the first containment panel 24 and the first closing panel 28 and the second closing panel 30 is foldable about a fold line 30A extending between the second containment panel 26 and the second closing panel 30. Each of the first and second closing panels 28 and 30 may have a width generally equal to one half the distance between the first and second containment panels 24 and 26 so that, when folded down to a generally horizontal position, the closing panels 28 and 30 cover and seal an inner cavity C within the container 10. It is also contemplated that the first and second closing panels 28 and 30 may have a width greater than or less than one half the distance between the first and second containment panels 24 and 26.

Figure 6:
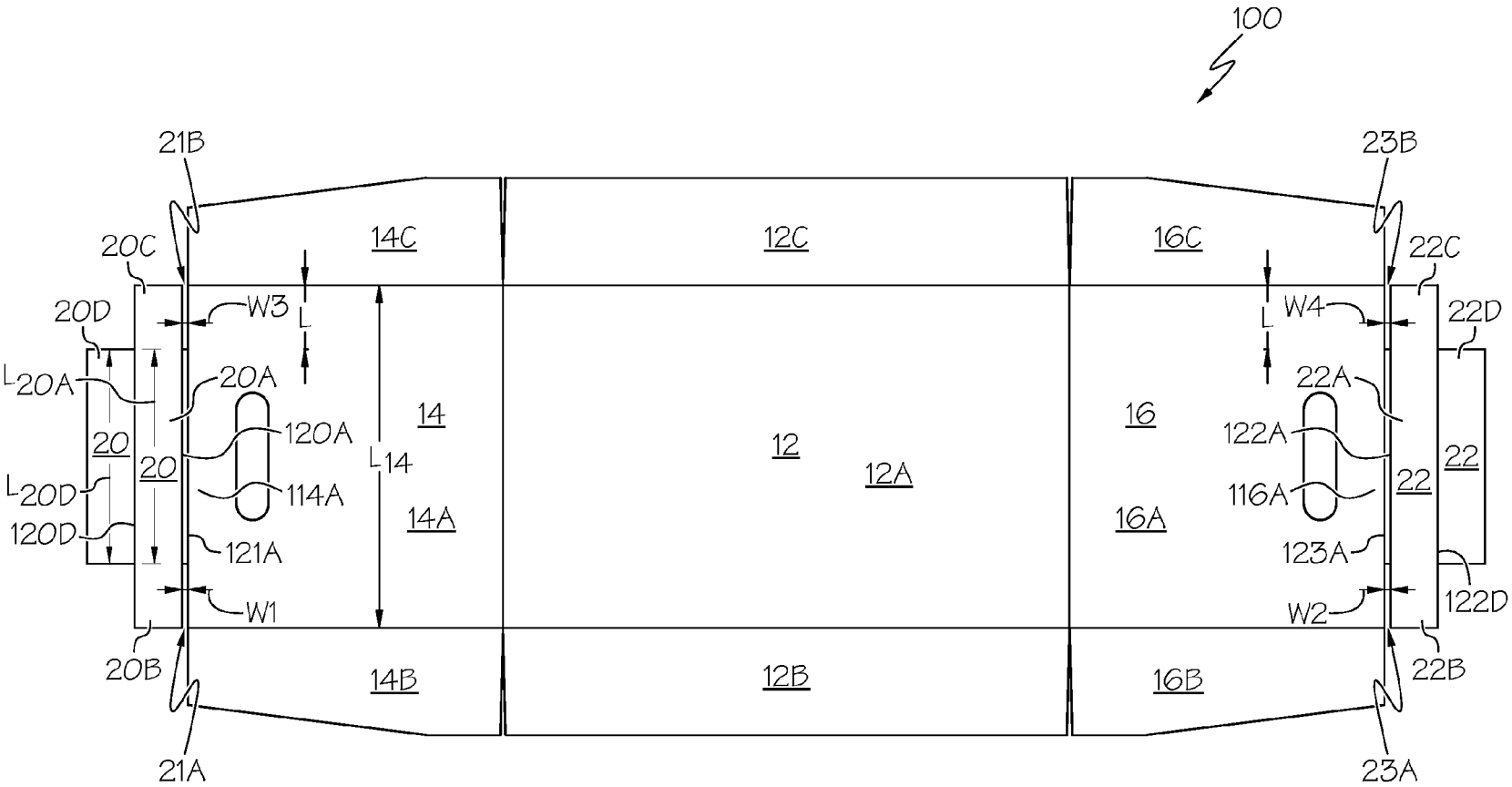
FIG. 6 illustrates a blank defining a floor panel, first and second end panels and first and second positioning panels prior to assembly of the container illustrated in FIG. 1.

The floor panel 12 comprises a central part 12A and first and second side parts 12B and 12C, see FIG. 6. During assembly, the first and second side parts 12B and 12C of the floor panel 12 are folded upward from the central part 12A about corresponding fold lines, see FIG. 1.

The first end panel 14 comprises a first main section 14A and first and second end sections 14B and 14C, which, after assembly of the container 10, extend inwardly approximately 90 degrees to the main section 14A. The second end panel 16 comprises a second main section 16A and third and fourth end sections 16B and 16C, which, after assembly of the container 10, extend inwardly approximately 90 degrees to the main section 16A.

Figure 4:
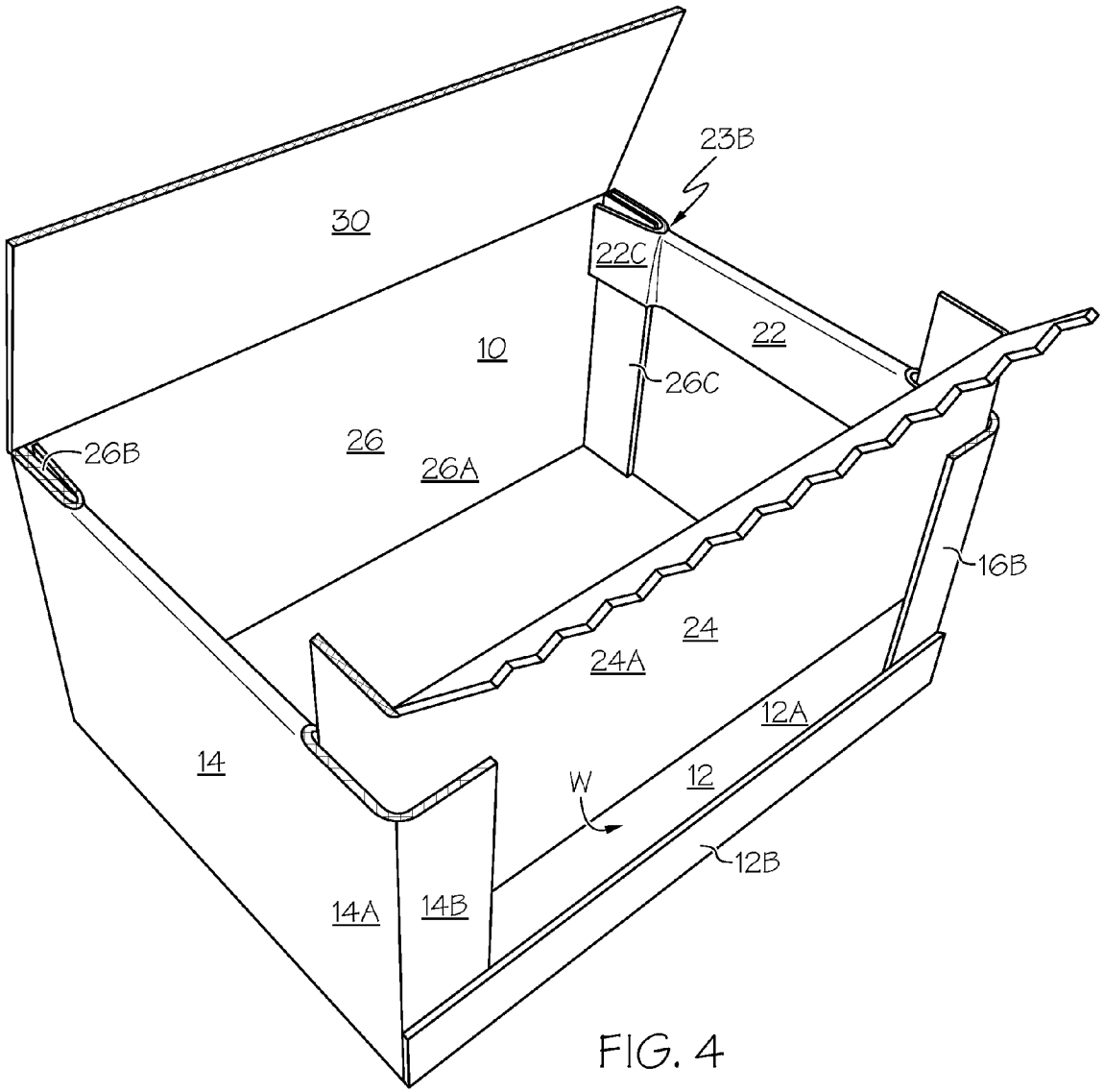

As is illustrated in FIGS. 1 and 4, the first side part 12B of the floor panel 12 is folded up, engages and is fastened, such as by a conventional adhesive, staples or other mechanical fasteners, to outer surfaces of the first end section 14B of the first end panel 14 and the third end section 16B of the second end panel 16. The second side part 12C of the floor panel 12 is folded up, engages and is fastened, such as by a conventional adhesive, staples or other mechanical fasteners, to outer surfaces of the second end section 14C of the first end panel 14 and the fourth end section 16C of the second end panel 16.

The first positioning panel 20 comprises a first center section 20A, first and second end sections 20B and 20C integral with and extending laterally from the center section 20A and a first outer section 20D integral with the center section 20A, see FIGS. 1 and 6. In the illustrated embodiment, the first center section 20A has a length $L_{20A}$ and the first outer section 20D has a length $L_{20D}$. The center section and outer section lengths $L_{20A}$ and $L_{20D}$ are less than a length $L_{14}$ of the first end panel 14. During assembly of the container 10, the outer section 20D is folded about fold line 120D over onto the center section 20A so as to define a dual layer center structure. The outer section 20D may be adhesively secured to the center section 20A. The dual layer center structure is then folded about adjacent fold lines 120A, 121A (also referred to herein as double fold lines) over onto an outer part 114A of the first main section 14A of the first end panel 14 such that the outer section 20D is sandwiched or positioned between the center section 20A and the first main section 14A of the first end panel 14. The dual layer center structure may be adhesively secured to the outer part 114A.

First and third notches 21A and 21B are provided between the first and second end sections 20B and 20C of the first positioning panel 20 and the first main section 14A of the first end panel 14, see FIGS. 1 and 6. The first and third notches 21A and 21B are defined by cuts extending between the first and second end sections 20B and 20C and the first main section 14A of the first end panel 14. In the illustrated embodiment, each of the first and third notches 21A and 21B has a length L equal to generally the length of an adjacent first or second end section 20B and 20C. In the illustrated embodiment, each of a first width $W_1$ of the first notch 21A and a third width $W_3$ of the third notch 21B is dimensioned so as to be generally equal to a thickness of the outer section 20D of the first positioning panel 20. Because the outer section 20D is positioned between the first positioning panel center section 20A and the first main section 14A of the first end panel 14, the first and second end sections 20B and 20C are spaced from the first end panel 14 by a distance generally equal to the thickness of the outer section 20D, which, as noted above, is generally equal to the widths $W_1$ and $W_3$ of the of the first and third notches 21A and 21B. The fold lines 120A, 121A are located between and are generally collinear with the cuts extending between the first and second end sections 20B and 20C and the first main section 14A. It is further contemplated that the first width $W_1$ of the first notch 21A and the third width $W_3$ of the third notch 21B may be dimensioned so as to be greater than or less than a thickness of the outer section 20D of the first positioning panel 20.

The second positioning panel 22 comprises a second center section 22A, third and fourth end sections 22B and 22C integral with and extending laterally from the center section 22A and a second outer section 22D integral with the center section 22A, see FIG. 6. During assembly of the container 10, the outer section 22D is folded about fold line 122D over onto the center section 22A so as to define a dual layer center structure. The outer section 22D may be adhesively secured to the center section 22A. The dual layer center structure is then folded about adjacent fold lines 122A, 123A (also referred to herein as double fold lines) over onto an outer part 116A of the second main section 16A of the second end panel 16 such that the outer section 22D is sandwiched or positioned between the center section 22A and the second main section 16A of the second end panel 16. The dual layer center structure may be adhesively secured to the outer part 116A.

Second and fourth notches 23A and 23B are provided between the third and fourth end sections 22B and 22C of the second positioning panel 22 and the second main section 16A of the second end panel 16. The second and fourth notches 23A and 23B are defined by cuts extending between the third and fourth end sections 22B and 22C and the second main section 16A of the second end panel 16. In the illustrated embodiment, each of the second and fourth notches 23A and 23B has a length L generally equal to the length of an adjacent third or fourth end section 22B and 22C. In the illustrated embodiment, each of a second width $W_2$ of the second notch 23A and a fourth width $W_4$ of the fourth notch 23B is dimensioned so as to be generally equal to a thickness of the outer section 22D of the second positioning panel 22. Because the outer section 22D is positioned between the second positioning panel center section 22A and the second main section 16A of the second end panel 16, once the container 10 is assembled, the third and fourth end sections 22B and 22C are spaced from the second end panel 16 by a distance generally equal to the thickness of the outer section 22D, which, as noted above, is generally equal to the widths $W_2$ and $W_4$ of the of the second and fourth notches 23A and 23B. The fold lines 122A, 123A are located between and generally collinear with the cuts extending between the third and fourth end sections 22B and 22C and the second main section 16A. It is further contemplated that the second width $W_2$ of the second notch 23A and the fourth width $W_4$ of the fourth notch 23B may be dimensioned so as to be greater than or less than a thickness of the outer section 22D of the second positioning panel 22.

The first containment panel 24 comprises a first main portion 24A and first and second end portions 24B and 24C, which, during assembly, are turned inwardly approximately 90 degrees to the first main portion 24A. The first and second end portions 24B and 24C are received respectively in the first notch 21A and the second notch 23A, see FIG. 1, such that the first containment panel 24 closes off a first window W defined by the first end section 14B of the first end panel 14, the third end section 16B of the second end panel 16 and the first side part 12B of the floor panel 12. With the first and second end portions 24B and 24C of the first containment panel 24 received in the first and second notches 21A and 23A, the first containment panel 24 is held in position via friction by: the first main section 14A of the first end panel 14 and the first end section 20B of the first positioning panel 20 contacting the first containment panel first end portion 24B located within the first notch 21A; the first end section 14B of the first end panel 14 and the first end section 20B of the first positioning panel 20 engaging a first end 24D of the first main portion 24A of the first containment panel 24; the second main section 16A of the second end panel 16 and the third end section 22B of the second positioning panel 22 contacting the first containment panel second end portion 24C located within the second notch 23A; and the third end section 16B of the second end panel 16 and the third end section 22B of the second positioning panel 20 engaging a second end 24E of the first main portion 24A of the first containment panel 24. Hence, no adhesive or mechanical fasteners are used to hold the first containment panel 24 in place relative to the remaining elements of the container 10. Because the first and second end portions 24B and 24C of the first containment panel 24 extend at an angle (approximately 90 degrees in the illustrated invention) to the first main portion 24A of the first containment panel 24 and are gripped the first and second end panels 14 and 16 and the first and second positioning panels 20 and 22, it is believed that the frictional securement of the first containment panel 24 to the remaining elements of the container 10 is enhanced relative to a containment panel, which is planar and does not have angled end portions. It is further believed that, because the first and second end portions 24B and 24C of the first containment panel 24 extend at an angle to the first main portion 24A of the first containment panel 24 and are gripped the first and second end panels 14 and 16 and the first and second positioning panels 20 and 22, the first containment panel 24 has enhanced stability in X and Y directions, see FIG. 1. For example, contents, e.g., egg cartons, provided within the inner cavity C of the container 10 are not needed to support the first containment panel 24.

Figure 3:
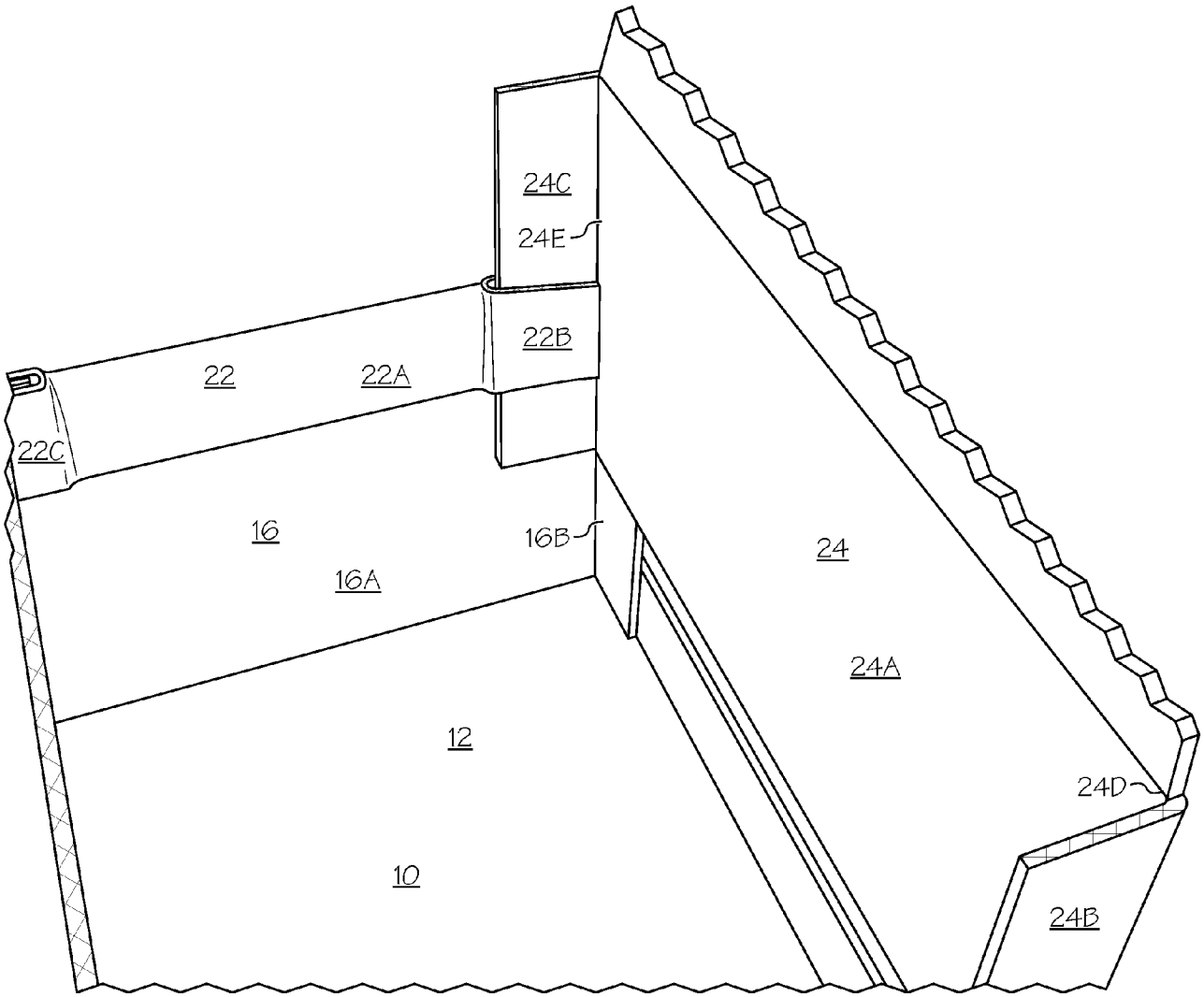
FIGS. 3 and 4 are perspective views of the container illustrated in FIG. 1 with a first containment panel moved upward from remaining elements of the container.

As illustrated in FIGS. 3-4, the first containment panel 24 can be manually removed, i.e., lifted vertically by a user, so as to transform the container 10 into the display tray 11 such that the contents within the container 10 are visible through the first window W. Because the first containment panel 24 is held in position by friction in the illustrated embodiment, i.e., no adhesive or mechanical fasteners are used to couple the first containment panel 24 to the first and second end panels 14 and 16 and the first and second positioning panels 20 and 22, removal of the first containment panel 24 does not require removal of fasteners or the breaking of adhesive bonds.

It is noted that because the outer section 20D of the first positioning panel 20 is positioned between the first positioning panel center section 20A and the first main section 14A of the first end panel 14, the width $W_1$ of the first notch 21A is approximately equal to the thickness of the outer section 20D, which is substantially equal to or slightly smaller than the thickness of the first containment panel first end portion 24B located within the first notch 21A. Further, because the outer section 22D of the second positioning panel 22 is positioned between the second positioning panel center section 22A and the second main section 16A of the second end panel 16, the width $W_2$ of the second notch 23A is approximately equal to the thickness of the outer section 22D, which is substantially equal to or slightly smaller than the thickness of the first containment panel second end portion 24C located within the second notch 23A. Hence, the amount of frictional engagement of the first containment panel first and second end portions 24B and 24C by the first and second end panels 14 and 16 and the first and second positioning panels 20 and 22 is sufficient to hold the first containment panel 24 in place but also allows the first containment panel 24 to be removed by a user.

The second containment panel 26 comprises a second main portion 26A and third and fourth end portions 26B and 26C, which, during assembly of the container 10, are turned inwardly approximately 90 degrees to the second main portion 26A. The third and fourth end portions 26B and 26C are received respectively in the third notch 21B and the fourth notch 23B, such that the second containment panel 26 closes off a second window defined by the second end section 14C of the first end panel 14, the fourth end section 16C of the second end panel 16 and the second side part of the floor panel 12. With the third and fourth end portions 26B and 26C of the second containment panel 26 received in the third and fourth notches 21B and 23B, the second containment panel 26 is held in position via friction by: the first main section 14A of the first end panel 14 and the second end section 20C of the first positioning panel 20 contacting the second containment panel third end portion 26B located within the third notch 21B; the second end section of the first end panel 14 and the second end section 20C of the first positioning panel 20 engaging a third end 26D of the second main portion 26A of the second containment panel 26; the second main section 16A of the second end panel 16 and the fourth end section 22C of the second positioning panel 22 contacting the second containment panel fourth end portion 26C located within the fourth notch 23B; and the fourth end section of the second end panel 16 and the fourth end section 22C of the second positioning panel 22 engaging a second end 26E of the second main portion 26A of the second containment panel 26. Hence, no adhesive or mechanical fasteners are used to hold the second containment panel 26 in place relative to the remaining elements of the container 10.

Because the third and fourth end portions 26B and 26C of the second containment panel 24 extend at an angle (approximately 90 degrees in the illustrated invention) to the second main portion 26A of the second containment panel 26 and are gripped the first and second end panels 14 and 16 and the first and second positioning panels 20 and 22, it is believed that the frictional securement of the second containment panel 26 to the remaining elements of the container 10 is enhanced relative to a containment panel, which is planar and does not have angled end portions. It is further believed that, because the third and fourth end portions 26B and 26C of the second containment panel 26 extend at an angle to the second main portion 26A of the second containment panel 26 and are gripped the first and second end panels 14 and 16 and the first and second positioning panels 20 and 22, the second containment panel 26 has enhanced stability in X and Y directions, see FIG. 1.

The second containment panel 26 can be manually removed, i.e., lifted vertically by a user, so as to further transform the container 10 into a display tray such that the contents within the display tray are visible through the second window. Because the second containment panel 26 is held in position by friction in the illustrated embodiment, i.e., no adhesive or mechanical fasteners are used to couple the second containment panel 26 to the first and second end panels 14 and 16 and the first and second positioning panels 20 and 22, removal of the second containment panel 26 does not require removal of fasteners or the breaking of adhesive bonds.

It is noted that because the outer section 20D of the first positioning panel 20 is positioned between the first positioning panel center section 20A and the first main section 14A of the first end panel 14, the width $W_3$ of the third notch 21B is approximately equal to the thickness of the outer section 20D, which is substantially equal to or slightly smaller than the thickness of the second containment panel third end portion 26B located within the third notch 21B. Further, because the outer section 22D of the second positioning panel 22 is positioned between the second positioning panel center section 22A and the second main section 16A of the second end panel 16, the width $W_4$ of the fourth notch 23B is approximately equal to the thickness of the outer section 22D, which is substantially equal to or slightly smaller than the thickness of the second containment panel fourth end portion 26C located within the fourth notch 23B. Hence, the amount of frictional engagement of the second containment panel third and fourth end portions 26B and 26C by the first and second end panels 14 and 16 and the first and second positioning panels 20 and 22 is sufficient to hold the second containment panel 26 in place but also allows the second containment panel 26 to be removed by a user.

It is contemplated that the shipping container 10 may be formed with a first positioning panel comprising only a first center section and first and second end sections and wherein an outer section, such as outer section 20D illustrated in FIG. 6, is not provided. Likewise, the shipping container 10 may be formed with a second positioning panel comprising only a second center section and third and fourth end sections and wherein an outer section, such as outer section 22D illustrated in FIG. 6, is not provided.

Figure 5:
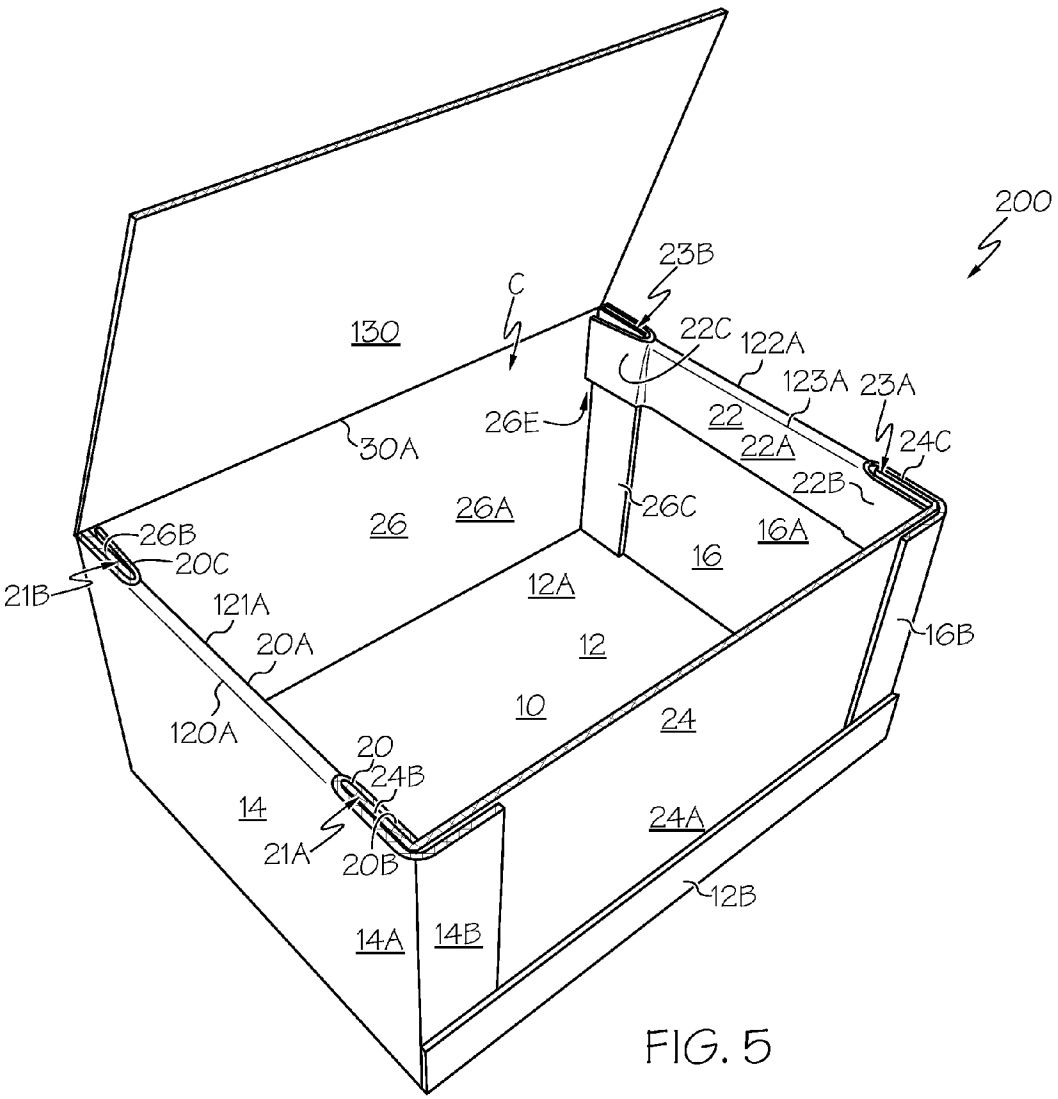
FIG. 5 is a perspective view of a shipping container of a second embodiment of the present invention having only a single closing panel.

A shipping container 200 constructed in accordance with a second embodiment of the present invention is illustrated in FIG. 5, where elements in the container 200 of the second embodiment that are the same as those found in the container 10 of the first embodiment, are marked with the same reference numerals. The container 200 is constructed in the same manner as the container 10 illustrated in FIGS. 1-4, except that only a single upper closing panel 130 is provided, which is integral with the second containment panel 26. The closing panel 130 is foldable about a fold line extending between the second containment panel 26 and the closing panel 130. The closing panel 130 may have a width generally equal to the distance between the first and second containment panels 24 and 26 so that, when folded down to a generally horizontal position, the closing panel 130 covers and seals an inner cavity C within the container 200. The closing panel 130 may alternatively extend from the first containment panel 24 instead of the second containment panel 26.

Figure 7:
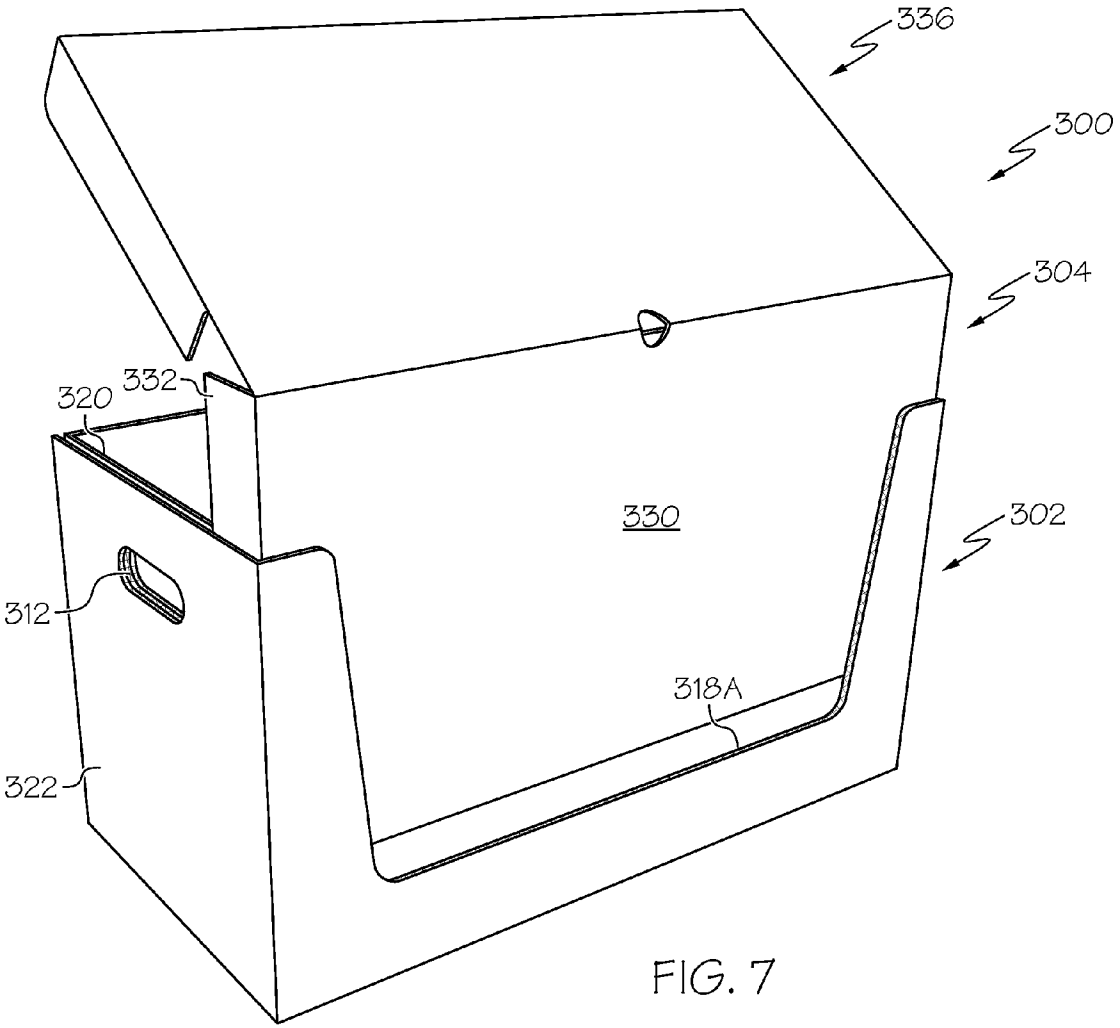
FIG. 7 is a perspective view of a shipping container of a third embodiment of the present invention with a containment panel partially removed.
Figure 8:
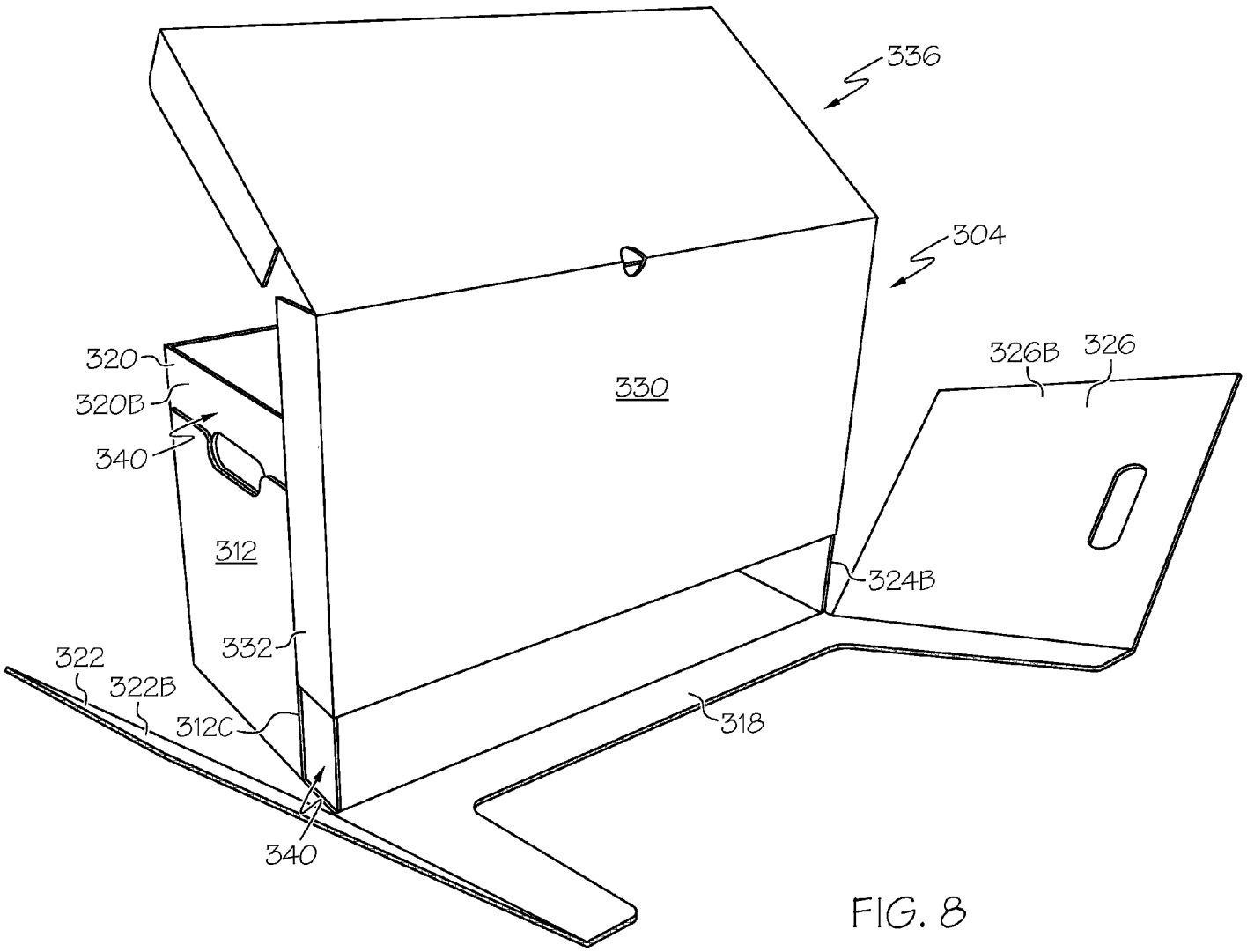
FIG. 8 is a perspective view of the container of FIG. 7 with first and second outer positioning panels positioned away from first and second end panels.
Figure 9:
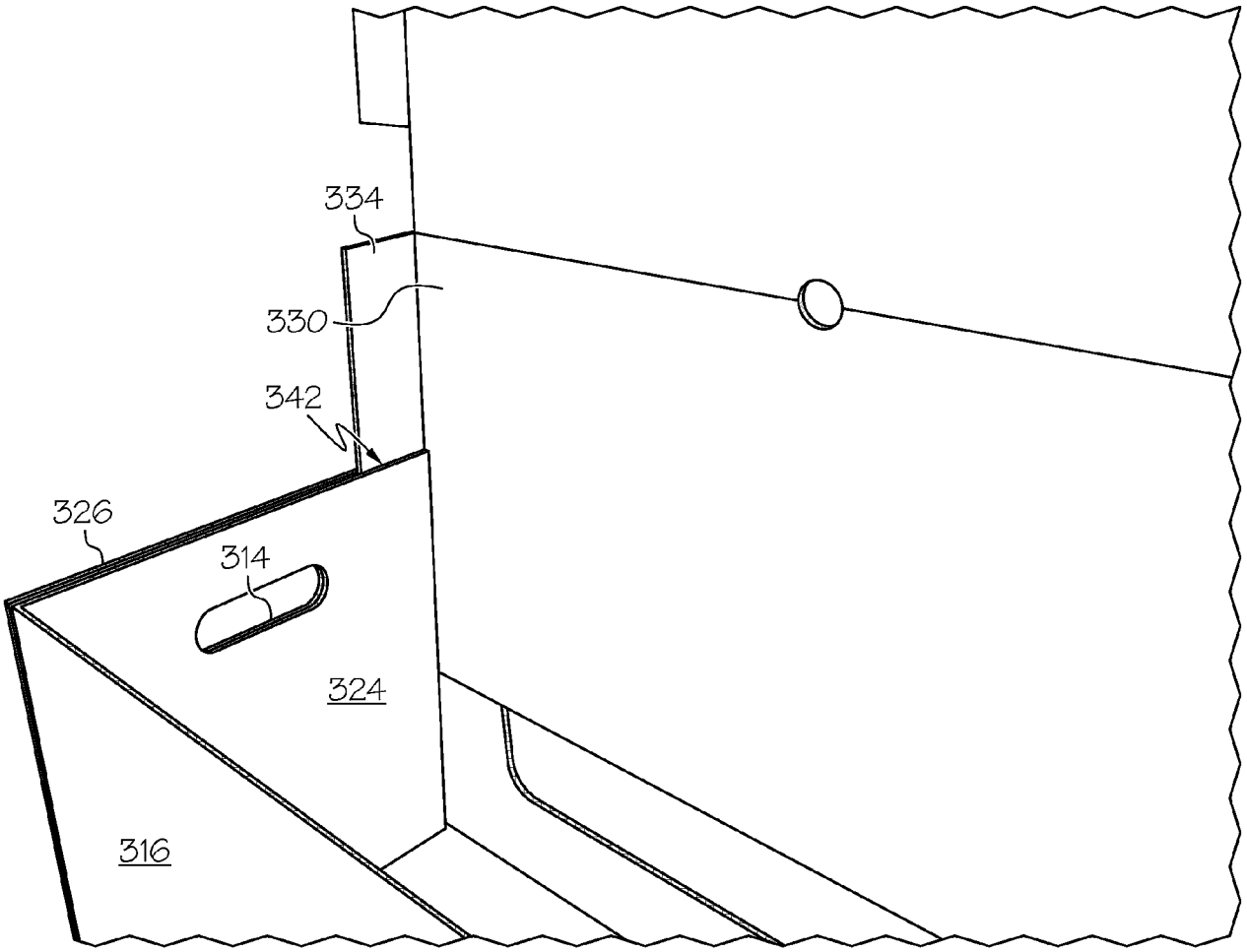
FIG. 9 is a perspective view of a portion of the shipping container of FIG. 7 with the containment panel partially removed.
Figure 10:
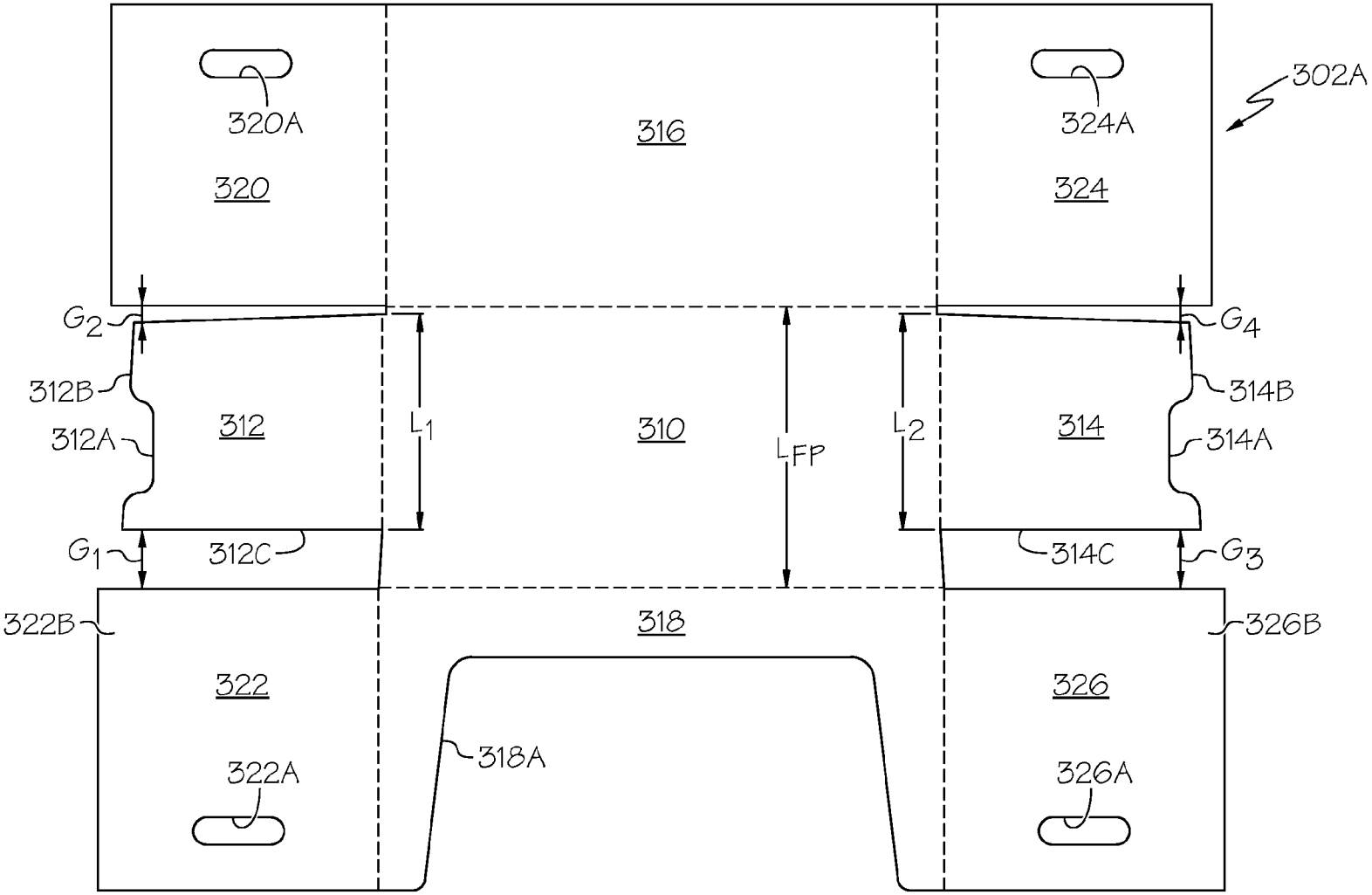
FIG. 10 is a blank used to form a display tray forming part of the shipping container of FIG. 7.

A shipping container 300 convertible to a display tray 302 constructed in accordance with a third embodiment of the present invention is illustrated in FIGS. 7-9. The shipping container 300 comprises the display tray 302 and a containment panel 304. The display tray 302 is illustrated as a blank 302A in FIG. 10 prior to being folded and assembled into the display tray 302 illustrated in FIGS. 7-9.

The display tray 302 comprises a floor panel 310, a first end panel 312, a second end panel 314, a first side panel 316, a second side panel 318, a first inner positioning panel 320, a first outer positioning panel 322, a second inner positioning panel 324, and a second outer positioning panel 326. In the illustrated embodiment, the first side panel 316 is integral with the floor panel 310 and the first and second inner positioning panels 320 and 324. The second side panel 318 is integral with the floor panel 310 and the first and second outer positioning panels 322 and 326. The first and second end panels 312 and 314 are integral with the floor panel 310.

In the illustrated embodiment, the first end panel 312 has a first length $L_1$ less than a length $L_{FP}$ of the floor panel 310. A first gap $G_1$ between the first end panel 312 and the first outer positioning panel 322 is greater than a second gap $G_2$ between the first end panel 312 and the first inner positioning panel 320, see FIG. 10. Further, the second end panel 314 has a second length $L_2$ less than the length $L_{FP}$ of the floor panel 310. A third gap $G_3$ between the second end panel 314 and the second outer positioning panel 326 is greater than a fourth gap $G_4$ between the second end panel 314 and the second inner positioning panel 324.

In the illustrated embodiment, the first inner and outer positioning panels 320 and 322 have first and second gripping slots 320A and 322A, which are adapted to be aligned with one another when the blank 302A is assembled. Further, the second inner and outer positioning panels 324 and 326 have third and fourth gripping slots 324A and 326A, which are adapted to be aligned with one another when the blank 302A is assembled. The first end panel 312 has a first recess 312A formed in an upper edge 312B thereof and, when the blank 302A is assembled, is aligned with the first and second gripping slots 320A and 322A in the first inner and outer positioning panels 320 and 322. Likewise, the second end panel 314 has a second recess 314A formed in an upper edge 314B thereof and, when the blank 302A is assembled, is aligned with the third and fourth gripping slots 324A and 326A in the second inner and outer positioning panels 324 and 326.

The second side panel 318 is notched so as to define a viewing window 318A when the containment panel 304 has been removed from the display tray 302. The viewing window 318A allows contents, e.g., egg cartons, within the display tray 302 to be visible to an observer.

The containment panel 304 comprises a first main portion 330, a first end portion 332 and a second end portion 334, see FIGS. 7-9 and 11. The first and second end portions 332 and 334 extend at an angle to the first main portion 330. In the illustrated embodiment, each of the first and second end portions 332 and 334 extends an angle of about 90 degrees to the first main portion 330. However, the angle between each of the first and second end portions 332 and 334 and the first main portion 330 may vary.

In the illustrated embodiment, an upper closing panel 336 is integral with the containment panel 304, see FIGS. 7-9 and 11. The upper panel 336 comprises a main section 336A and first and second end sections 336B and 336C.

Once the blank 302A has been assembled, the first end panel 312 is located between the first inner and outer positioning panels 320 and 322, see FIGS. 7 and 8, and a first notch 340 is defined by a substantially vertical edge 312C of the first end panel 312, an outer surface 320B of the first inner positioning panel 320 and an inner surface 322B of the first outer positioning panel 322. Also once the blank 302A has been assembled, the second end panel 314 is located between the second inner and outer positioning panels 324 and 326, see FIGS. 9 and 11, and a second notch 342 is defined by a substantially vertical edge 314C of the second end panel 314, an outer surface 324B of the second inner positioning panel 324 and an inner surface 326B of the second outer positioning panel 326, see also FIG. 8.

During assembly of the shipping container 300, the containment panel 304 is positioned such that the first end portion 332 is located in the first notch 340 and the second end portion 334 is located in the second notch 342, see FIGS. 8 and 9. A lower edge 304A of the containment panel 304 is preferably near or in contact with the floor panel 310. Hence, once the shipping container 300 has been assembled, the first inner and outer positioning panels 320 and 322 frictionally engage the containment panel first end portion 332 and the second inner and outer positioning panels 324 and 326 frictionally engage the containment panel second end portion 334 to frictionally hold the containment panel 304 in position such that the containment panel 304 substantially fully covers the viewing window 318A in the second side panel 318.

Figure 11:
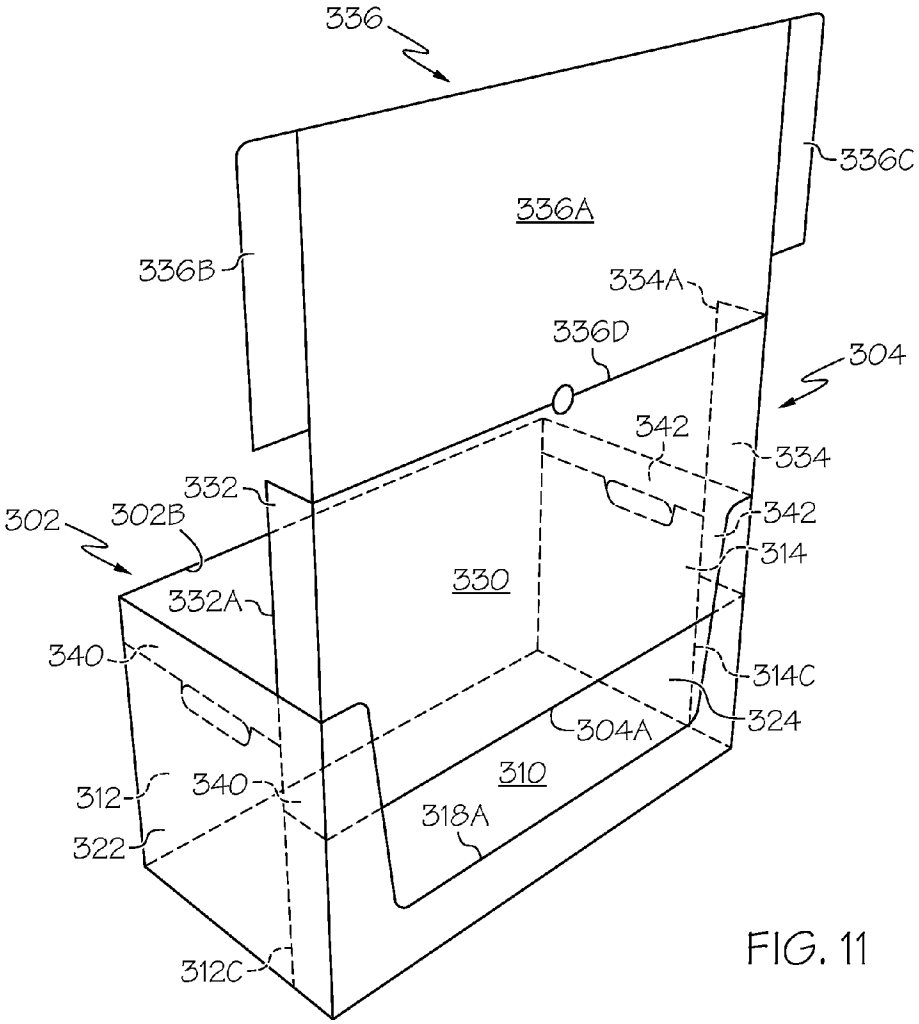
FIG. 11 is a perspective view of the shipping container of FIG. 7 with the containment panel partially removed.

In the illustrated embodiment, each of the first and second notches 340 and 342 has a generally L shape, see FIGS. 8 and 11. During assembly of the shipping container 300, the upper panel 336 may be pivoted about a fold line 336D relative to the containment panel 304 so as to close off an upper opening 302B of the display tray 302. The first and second end sections 336B and 336C of the upper panel 336 are received in the first and second notches 340 and 342 when the upper panel 336 is moved to its closed position.

The first and second notches 340 and 342 may extend at least the entire heights of the first and second end panels 312 and 314. Hence, vertical edges 332A and 334A of the containment panel first and second end portions 332 and 334 are supported along a substantial portion of their heights by the vertical edges 312C and 314C of the first and second end panels 312 and 314.

The containment panel 304 is preferably not fastened or adhesively adhered to any of the first and second end panels 312 and 314 and the first and second inner and outer positioning panels 320, 322, 324 and 326.

The containment panel 304 is vertically removable to convert the shipping container 300 into the display tray 302 to allow contents within the display tray 302 to be visible through the viewing window 318A.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shipping container convertible to a display tray comprising:

a floor panel;

first and second end panels;

a first positioning panel being foldably joined to said first end panel and defining a first notch with said first end panel;

a side panel;

a first containment panel comprising a first main portion and a first end portion foldably joined and extending at an angle to said first main portion, said first end portion located in said first notch such that said first end panel and said first positioning panel frictionally engage said containment panel first end portion to frictionally hold said first containment panel in position, said first containment panel being removable so as to convert the shipping container to a display tray.

2. The shipping container as set out in claim 1, wherein said first and second end panels are integral with said floor panel.

3. The shipping container as set out in claim 1, further comprising a second positioning panel defining a second notch with said second end panel, said first containment panel further comprising a second end portion extending at an angle to said first main portion, said first containment panel second end portion being located in said second notch such that said second end panel and said second positioning panel frictionally engage said containment panel second end portion.

4. The shipping container as set out in claim 3, wherein said first and second end portions of said first containment panel extend generally orthogonally to said first main portion.

5. The shipping container as set out in claim 3, wherein said first positioning panel is integral with said first end panel and said second positioning panel is integral with said second end panel.

6. The shipping container as set out in claim 1, wherein said first end panel comprises a first main section and first and second end sections extending at an angle to said first main section.

7. The shipping container as set out in claim 6, wherein said second end panel comprises a second main section and third and fourth end sections extending at an angle to said second main section.

8. The shipping container as set out in claim 7, wherein said first end section of said first end panel and said third end section of said second end panel overlap said first containment panel first main portion.

9. The shipping container as set out in claim 1, wherein said side panel comprises a removable second containment panel.

10. The shipping container as set out in claim 9, wherein said removable second containment panel comprises a second main portion and a third end portion extending at an angle to said second main portion, said third end portion located in a third notch defined by said first end panel and said first positioning panel such that said first end panel and said first positioning panel frictionally engage said second containment panel third end portion to frictionally hold said second containment panel in position, said second containment panel being removable.

11. The shipping container as set out in claim 10, wherein said second positioning panel and said second end panel define a fourth notch, said second containment panel further comprising a fourth end portion extending at an angle to said second main portion, said second containment panel fourth end portion being located in said fourth notch such that said second end panel and said second positioning panel frictionally engage said second containment panel fourth end portion.

12. The shipping container as set out in claim 1, further comprising a first upper panel integral with said side panel.

13. The shipping container as set out in claim 12, further comprising a second upper panel integral with said first containment panel.

14. The shipping container as set out in claim 1, further comprising an upper panel integral with one of said side panel and said first containment panel and extending between said side panel and said first containment panel.

15. The shipping container as set out in claim 1, wherein said containment panel is not fastened or adhesively adhered to any of said first and second end panels and said first positioning panel.

16. A shipping container convertible to a display tray comprising:

a floor panel;

first and second end panels;

a first positioning panel being foldably joined to said first end panel and comprising a first center section and a first outer section folded over onto the first center section so as to define a first dual layer center structure, said first positioning panel defining a first notch with said first end panel, wherein the first notch has a width generally equal to a thickness of the first outer section;

a first containment panel comprising a first main portion and a first end portion foldably joined and extending at an angle to said first main portion, said first end portion located in said first notch such that said first end panel and said first positioning panel frictionally engage said containment.

17. The shipping container as set out in claim 16, further comprising a second positioning panel comprising a second center section and a second outer section folded over onto the second center section so as to define a second dual layer center structure, said second positioning panel defining a second notch with said second end panel, said first containment panel further comprising a second end portion extending at an angle to said first main portion, said first containment panel second end portion being located in said second notch such that said second end panel and said second positioning panel frictionally engage said containment panel second end portion.

18. A blank adapted to be formed into a display tray comprising:

a floor panel;

first and second end panels integral with the floor panel;

a first positioning panel comprising a first center section integral with the first end panel and a first outer section integral with the first center section, wherein said first positioning panel further comprises first and second end sections integral with and extending laterally from said first center section, said first center section and said first outer section having a length less than a length of the first end panel and said first and second end sections define notches with said first end panel; and a second positioning panel comprising a second center section integral with the second end panel and a second outer section integral with the second center section.

19. The blank as set out in claim 18, wherein a first set of double fold lines are provided between the first positioning panel center section and the first end panel and a second set of double fold lines are provided between the second positioning panel center section and the second end panel.

* * * * *